US009643063B2

(12) United States Patent
Hebert

(10) Patent No.: US 9,643,063 B2
(45) Date of Patent: May 9, 2017

(54) GOLF BALLS INCORPORATING AT LEAST ONE THERMOSET AND/OR THERMOPLASTIC LAYER/COATING/FILM VIA REACTIVE SPRAY

(71) Applicant: Acushnet Company, Fairhaven, MA (US)

(72) Inventor: Edmund A. Hebert, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 1 day.

(21) Appl. No.: 14/819,511

(22) Filed: Aug. 6, 2015

(65) Prior Publication Data

US 2017/0036072 A1 Feb. 9, 2017

(51) Int. Cl.

| | |
|---|---|
| ***A63B 37/00*** | (2006.01) |
| ***A63B 45/00*** | (2006.01) |
| ***B05D 5/00*** | (2006.01) |

(52) U.S. Cl.

CPC ..... *A63B 45/00* (2013.01); *B05D 5/00* (2013.01); *B05D 2201/02* (2013.01)

(58) Field of Classification Search

None

See application file for complete search history.

(56) References Cited

U.S. PATENT DOCUMENTS

| | | | |
|---|---|---|---|
| 3,801,020 | A | 4/1974 | Mocarski |
| 3,958,758 | A | 5/1976 | Pierkowski |

(Continued)

OTHER PUBLICATIONS

A. Bhatia, "Thermal Spraying Technology and Applications" Course No. T04-002, Credit: 4 PDH, Jan. 29, 1999, CEDEngineering.com, p. 3-4.

Frank J. Hermanek, "What is Thermal Spray?", International Thermal Spray Association Apr. 11, 2009, p. 3.

*Primary Examiner* — Nathan T Leong

(74) *Attorney, Agent, or Firm* — Margaret C. Barker

(57) ABSTRACT

A method of forming a golf ball comprising at least one layer consisting of at least one of a thermoset or thermoplastic composition comprising the steps of: providing a subassembly having at least one of an innermost surface or an outermost surface; providing at least one polymeric mixture $P_c$ comprising a plurality of particles having a softening, melting and/or reacting temperature $M_p$; heating a fluid with a heat source that does not contact $P_c$ to a temperature $M_{ph}$ wherein $M_p \leq M_{ph}$ to form a heated fluid; softening, melting and/or reacting the plurality of particles by mixing each polymeric mixture $P_c$ with at least one heated fluid and forming at least one heated mixture $P_{cs}$; and propelling each $P_{cs}$ onto at least one of the innermost surface or the outermost surface to form a thermoset and/or thermoplastic layer $T_{mpl}$ about the outermost surface which may be comprised of a heterogeneous composition. The thickness of $T_{mpl}$ may be from about 3 mils to about 0.10 in.

7 Claims, 6 Drawing Sheets

(56) References Cited

U.S. PATENT DOCUMENTS

| | | | | |
|---|---|---|---|---|
| 4,361,111 | A * | 11/1982 | Groen | B05C 13/025 118/503 |
| 4,416,421 | A | 11/1983 | Browning | |
| 4,694,990 | A | 9/1987 | Karlsson et al. | |
| 5,236,327 | A | 8/1993 | Flanagan et al. | |
| 5,285,967 | A | 2/1994 | Weidman | |
| 5,328,959 | A | 7/1994 | Sullivan | |
| 5,503,872 | A * | 4/1996 | MacKenzie | B05B 7/14 239/13 |
| 5,723,187 | A | 3/1998 | Popoola et al. | |
| 5,783,293 | A | 7/1998 | Lammi | |
| 5,932,293 | A | 8/1999 | Belashchenko et al. | |
| 5,938,944 | A | 8/1999 | Baughman et al. | |
| 6,612,939 | B1 * | 9/2003 | Sullivan | A63B 37/00 473/374 |
| 6,676,541 | B2 | 1/2004 | Cavallaro et al. | |
| 7,216,814 | B2 | 5/2007 | Gardega | |
| 9,011,275 | B2 | 4/2015 | Hebert et al. | |
| 2002/0022537 | A1 | 2/2002 | Nesbitt et al. | |
| 2006/0166153 | A1 | 7/2006 | Rusch et al. | |
| 2009/0095823 | A1 | 4/2009 | Gardega et al. | |
| 2010/0248862 | A1 | 9/2010 | Sullivan et al. | |
| 2010/0323817 | A1 | 12/2010 | Molinari | |
| 2011/0224023 | A1 | 9/2011 | Tutmark | |
| 2013/0270745 | A1 * | 10/2013 | Hebert | A63B 37/0003 264/443 |
| 2015/0182813 | A1 | 7/2015 | Hebert et al. | |

* cited by examiner

GOLF BALLS INCORPORATING AT LEAST ONE THERMOSET AND/OR THERMOPLASTIC LAYER/COATING/FILM VIA REACTIVE SPRAY

FIELD OF THE INVENTION

Golf balls incorporating thermoset and/or thermoplastic layers/coatings/films via spray techniques.

BACKGROUND OF THE INVENTION

Golf balls are made in a variety of constructions and compositions. Generally, a core is surrounded by a cover, with at least one intermediate layer optionally disposed there between. Examples of conventional golf ball materials range from balata to polybutadiene, ionomer resins, polyurethanes, and/or polyureas. Typically, outer layers are formed about the spherical outer surface of an inner golf ball component via compression molding, casting, or injection molding.

Golf ball manufacturers continuously experiment with constructions and material formulations in order to target, improve and/or preserve aerodynamic and/or inertial properties and achieve desired feel without sacrificing durability. Thinner golf ball layers are often useful for preventing moisture penetration into inner golf ball layers and/or for promoting adhesion between golf ball layers. However, thinner layers can be quite difficult to incorporate reliably during conventional golf ball manufacturing processes such as compression molding or reaction pin injection molding (RPIM). Specifically, when incorporating thin layers, there may be insufficient space to flow out material in RPIM. And compression molding of thin layers can result in "flow lines" at the parting line of the outer material because inner materials can re-melt during the process of applying a very thin outer shell.

For this reason, golf ball manufacturers have sought more flexible processes that can form layers of any desired thickness within golf balls easily and cost effectively. In this regard, conventional thermal spraying techniques such as plasma arc spray, electric arc spray, and flame spray have been considered. See, e.g., U.S. Pat. No. 6,612,939 to Sullivan et al.; and U.S. Pat. No. 8,568,837 to Tomita et al., each of which is hereby incorporated by reference herein in its entirety. However, one drawback with applying golf ball layers via conventional thermal spray methods is that the spray material and the substrate to be coated are vulnerable to damage because each are directly exposed to the heat source as the polymer material is directed onto the substrate's surface. Damage such as unwanted inclusions and/or reduced physical properties of either layer result, which negatively impacts overall golf ball playing characteristics, durability and/or service life span. These drawbacks translate to increased golf ball manufacturing costs. Thus, there is a continued need for methods of making golf balls incorporating layers of any thickness without the risk of a damaging the thin layer material and/or the substrate.

Meanwhile, golf ball manufacturers seek to produce golf balls incorporating single layers that can exhibit multiple desirable properties/characteristics in order to reduce the added manufacturing costs associated with incorporating multiple layers in a golf ball. Ionomer-based formulations typically impart excellent shear and abrasion resistance at Shore D hardnesses of greater than about 60. And castable/injection moldable polyurethane/polyurea formulations can impart both exceptional feel and shear/abrasion resistance at lower hardnesses. Balata, while sometimes difficult to work with, offers great feel. However, combining each of these qualities in a single layer can be challenging.

One golf ball manufacturer tried blending/intermingling the materials of two separate layers into a dimensionally non-distinct blend of those materials via conventional compression molding. See U.S. Pat. No. 9,011,275 of Hebert et al., and related U.S. Patent Publ. No. 2015/0182813, hereby incorporated by reference herein in its entirety. In that golf ball, an original boundary between the two otherwise separate existing layers was eliminated following molding due to differing melt flow rates between the materials of each layer. However, in this approach, two initially separate layers are combined. Thus, there is still a need for golf ball constructions wherein differing materials can be combined initially within and throughout an entire single layer and having any thickness—without the need to modify a boundary between two existing separate layers. Such a unique golf ball formation and construction would be cost effective, improve manufacturing efficiency, and offer new ways for targeting desired properties/playing characteristics.

The golf balls of the present invention and methods of making same consider and solve all of these aforementioned needs.

SUMMARY OF THE INVENTION

Accordingly, in one embodiment, the invention is directed to a method of forming a golf ball comprising at least one layer consisting of at least one of a thermoset or thermoplastic composition comprising the steps of: providing a subassembly having an outermost surface; providing a polymeric mixture $P_c$ comprising a plurality of particles having a softening, melting and/or reacting temperature $M_p$; heating a fluid with a heat source that does not contact $P_c$ to a temperature $M_{ph}$ wherein $M_p \leq M_{ph}$ to form a heated fluid; softening, melting and/or reacting the plurality of particles by mixing $P_c$ with the heated fluid to form a heated mixture $P_{cs}$; and propelling $P_{cs}$ onto the outermost surface to form at least one thermoset and/or thermoplastic layer $T_{mpl}$ about the outermost surface.

In one embodiment, $M_{ph}$ is less than a melting/softening/reacting temperature $M_o$ of the outer surface. In another embodiment, $M_{ph}$ is equal to or greater than a softening, melting and/or reacting temperature $M_o$ of the outer surface and $P_{cs}$ has a temperature $M_{cs}$ that is less than $M_o$ when $P_{cs}$ is propelled onto the outermost surface.

In one embodiment, the fluid is a gas, although it is envisioned that the fluid may comprise any suitable medium or state.

In one embodiment, $T_{mpl}$ may have a thickness of from about 3 mils to about 0.10 in. In another embodiment, $T_{mpl}$ may have a thickness of from about 3 mils to about 35 mils.

$P_c$ may be selected from the group consisting of thermoset materials, thermoplastic materials, syntactic foams, or combinations thereof. In one embodiment, $P_c$ comprises a powder.

The heat source may comprise at least one of a flame-based heat source, a gas-based heat source or an electrical-based heat source. In one embodiment, the heat source does not contact the outermost surface.

$P_c$ may least partially interact with the outer surface when $P_{cs}$ contacts the outer surface.

In a golf ball of the invention, the subassembly may comprises at least one of: (i) a core; (ii) a core surrounded by at least one intermediate layer; (iii) a core surrounded by a cover; or (iv) a core, a cover and at least one coating layer surrounding the cover.

In one embodiment, the golf ball comprises first and second layers $T_{mpl1}$ and $T_{mpl2}$. $T_{mpl1}$ may consist of a thermoset material and $T_{mpl2}$ may consist of a thermoplastic material. Alternatively, $T_{mpl1}$ and $T_{mpl2}$ may be comprised of different thermoset materials. Or, $T_{mpl1}$ and $T_{mpl2}$ may be comprised of different thermoplastic materials. In one embodiment, $T_{mpl1}$ and $T_{mpl2}$ may be adjacent and have different melting/softening/reacting temperatures. In another embodiment, $T_{mpl1}$ and $T_{mpl2}$ have at least one different layer disposed there between.

The subassembly may be stationary while $P_{cs}$ is propelled onto the outermost surface. Alternatively, the subassembly may be at least partially rotating or is otherwise suspended while $P_{cs}$ is propelled onto the outermost surface.

$T_{mpl}$ can be an outer core layer. In one embodiment, the subassembly comprises a core and $T_{mpl}$ is an intermediate layer. In another embodiment, the subassembly comprises an intermediate layer surrounding a core and $T_{mpl}$ is an inner cover layer.

The fluid may in one embodiment be heated in a compartment that prevents $P_c$ and the outer surface from being exposed to the heat source.

In one embodiment, $P_{cs}$ may be propelled onto the outermost surface simultaneously with at least one different heated mixture $P_{cs'}$ such that $P_{cs}$ at least partially mixes or blends with $P_{cs'}$ to form $T_{mpl}$. $T_{mpl}$ may have a uniform thickness T and comprise $P_{cs}$ and $P_{cs'}$ in a ratio that varies throughout T. Alternatively, $T_{mpl}$ may have a non-uniform thickness T' and comprise $P_{cs}$ and $P_{cs'}$ in a wt. % ratio $P_{cs}$:$P_{cs'}$ that varies throughout T'.

In another embodiment, the invention is directed to a method of forming a golf ball comprising at least one layer consisting of at least one of a thermoset or thermoplastic composition comprising the steps of: providing a first half shell mold having a first innermost surface and a second half shell having a second innermost surface; providing a polymeric mixture $P_c$ comprising a plurality of particles having a softening, melting and/or reacting temperature $M_p$; heating a fluid with a heat source that does not contact $P_c$ to a temperature $M_{ph}$ wherein $M_p \leq M_{ph}$ to form a heated fluid; softening, melting and/or reacting the plurality of particles by mixing $P_c$ with the heated fluid to form a heated mixture $P_{cs}$; and propelling $P_{cs}$ onto the first innermost surface and the second innermost surface and forming at least one thermoset and/or thermoplastic layer $T_{mpl}$ on each innermost surface; and mating the first and second half shell molds about a subassembly.

In yet another embodiment, the invention is directed to a method of manufacturing a golf ball comprising a single layer comprised of a heterogeneous thermoset and/or thermoplastic composition, the method comprising: providing a subassembly having at least one of an innermost surface or an outermost surface; providing at least two polymeric mixtures $P_c$ and $P_{c'}$; wherein polymeric mixture $P_c$ comprises a plurality of particles that differ from a plurality of particles of polymeric mixture $P_{c'}$; and wherein polymeric mixture $P_c$ has a softening, melting and/or reacting temperature $M_p$ and polymeric mixture $P_{c'}$ has a softening, melting and/or reacting temperature $M_{p'}$; heating at least one fluid, with a heat source that does not contact $P_c$ and $P_{c'}$, to a temperature $M_{ph}$ wherein $M_p \leq M_{ph}$ and $M_{p'} \leq M_{ph}$ to form a heated fluid; softening, melting and/or reacting the plurality of particles of $P_c$ and $P_{c'}$ by mixing $P_c$ and $P_{c'}$ with the at least one heated fluid to form a heated mixture $P_{cs}$ and a heated mixture $P_{cs'}$; and coordinating/timing propelling of heated mixture $P_{cs}$ and a heated mixture $P_{cs'}$ onto at least one of the innermost surface or the outermost surface to form a single layer $T_{hmpl}$ of a heterogeneous thermoset and/or thermoplastic composition about the outermost surface comprised of the plurality of particles of $P_c$ and $P_{c'}$. Differing materials can be combined within and throughout an entire single layer having any thickness without the need to modify a boundary between two existing separate layers.

In one embodiment, heated mixture $P_{cs}$ and heated mixture $P_{cs'}$ at least partially mix while being propelled onto the outermost surface. In another embodiment, heated mixture $P_{cs}$ and heated mixture $P_{cs'}$ are propelled/directed onto the outer surface separately and propelling of each is timed coordinated such that heated mixture $P_{cs}$ and heated mixture $P_{cs'}$ at least partially mix on the outer surface when forming a single layer $T_{hmpls}$.

In yet another embodiment, $T_{hmpl}$ has a uniform thickness T and comprises $P_{cs}$ and $P_{cs'}$ in a ratio $P_{cs}$:$P_{cs'}$ that varies throughout T. In still another embodiment, $T_{hmpl}$ has a uniform thickness T and comprises $P_c$ and $P_{c'}$ in a ratio $P_c$:$P_{c'}$ that varies throughout T.

In an alternative embodiment, $T_{hmpl}$ has a non-uniform thickness T and comprises $P_{cs}$ and $P_{cs'}$ in a ratio $P_{cs}$:$P_{cs'}$ that varies throughout T. In a different embodiment, $T_{hmpl}$ has a non-uniform thickness T and comprises $P_c$ and $P_{c'}$ in a ratio $P_c$:$P_{c'}$ that varies throughout T.

In such an embodiment, the resulting golf ball therefore may comprise a subassembly having at least one of an inner surface or an outer surface; and a layer $T_{hmpls}$ disposed thereabout that is at least partially comprised of a heterogeneous polymeric composition mixture M within its thickness T; mixture M being comprised of a mixture of a heated mixture $P_{cs}$ and a different heated mixture $P_{cs'}$ that are propelled together either simultaneously or sequentially onto at least one of the inner surface or the outer surface to form $T_{hmpls}$.

BRIEF DESCRIPTION OF THE DRAWINGS

The accompanying drawings form a part of the specification and are to be read in conjunction therewith. The illustrated embodiments, however, are merely examples and are not intended to be limiting. Like reference numerals and designations in the various drawings indicate like elements.

FIG. 2 depicts a side view of a subassembly having layer $T_{hmpl}$ formed thereabout via the system of FIG. 1, wherein $T_{hmpl}$ results from heated mixtures $P_{cs}$ and $P_{cs'}$ being propelled onto the outermost surface simultaneously such that $P_{cs}$ at least partially mixes or blends with $P_{cs'}$ while being propelled to form $T_{hmpl}$;

DETAILED DESCRIPTION

Figure 1:
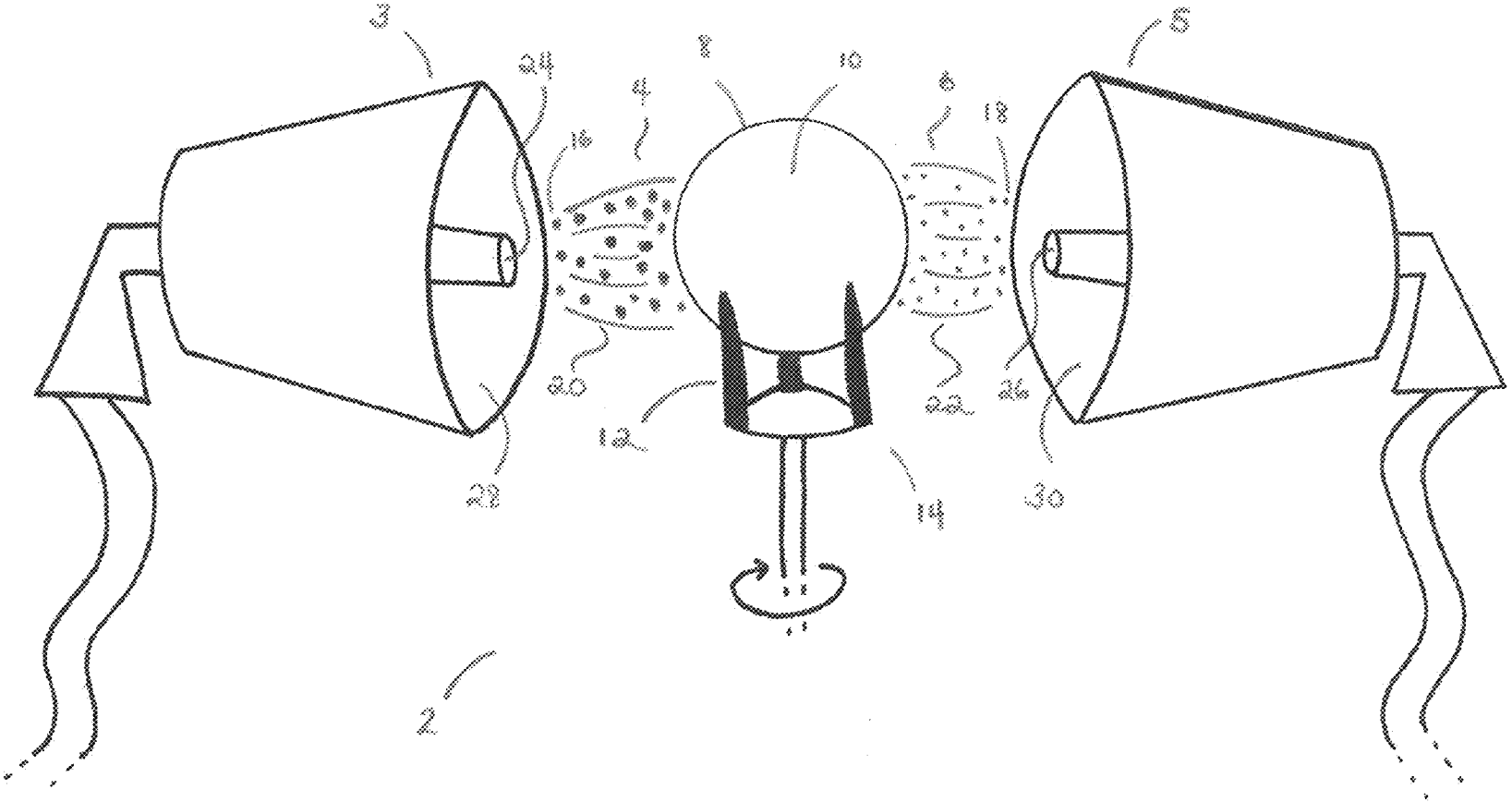
FIG. 1 depicts a side view of one system for forming layer $T_{hmpl}$ about a golf ball subassembly, $T_{hmpl}$ comprised of a heterogeneous composition of two differing heated mixtures $P_{cs}$ and $P_{cs'}$.
Figure 7:
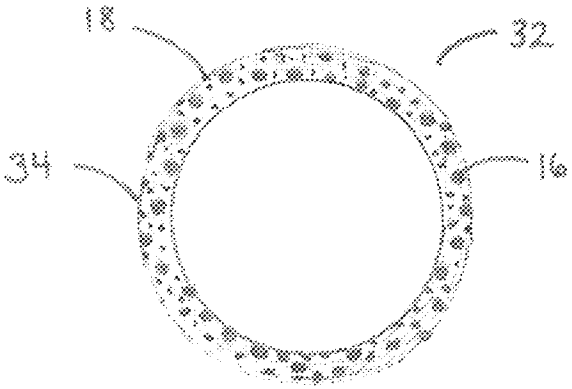

A golf ball may be manufactured reliably, efficiently and cost effectively, incorporating at least one thermoplastic and/or thermoset layer/coating/film having any desired thickness and, in some embodiments, comprised of a heterogeneous composition comprising a mixture of at least two compositions having different desirable properties. In a method of the invention for making a golf ball, at least one thermoplastic and/or thermoset layer may be formed onto, about or within any substrate/layer/mold surface. A heated fluid (e.g. air) surrounds and mixes with a stream of polymeric particles, forming a heated mixture wherein polymeric particles are softened, melted and/or begin reacting. At least one such heated mixture may then be propelled onto the surface to be layered, coated and/or filmed.

Importantly, polymeric particles never contact the heat source directly; only the surrounding fluid has been exposed to the heat source. Accordingly, the resulting layer/coating/film is free from damage or undesirable modification since the polymeric particles are protected from direct exposure to the heat source. A golf ball incorporating such a layer/coating/film therefore different and improved over prior conventional golf balls wherein the layer/coating/film material being sprayed to form a layer/coating/film on a subassembly surface is directly exposed to the heat source as it is sprayed or otherwise urged onto the substrate.

In this way, in the present invention, a wide range of thermoplastics/ionomers, thermosets, engineered coatings, and syntactic foams can be applied in any desired thicknesses onto a golf ball substrate surface. Thin layers not easily obtained in conventional injection or compression molding processes are now easily thereby formed. Such layers can be formed onto subordinate golf ball layers or spun on a spindle as in a golf ball painting process, or alternately, be sprayed into the cavities of a mold prior to a subsequent compression/injection, or cast molding operation.

The at least one thermoset and/or thermoplastic layer may at least partially interact with an adjacent substrate golf ball layer at an interface there between so as to create desirable adhesion or adhesive strength between the two layers. In this regard, the term interaction refers to crosslinking, fusion, for example and extends to any known mechanism for creating strong adhesion or bonding between golf ball layers. With thermoplastic subassemblies or substrates in particular, the layer/coating/film material being sprayed should have a softening/melting/reacting temperature that is less than that of the thermoplastic substrate/subassembly to prevent damage to or undesirable modification of the substrate/subassembly onto which the layer/coating/film is being formed Embodiments are envisioned wherein multiple—i.e., at least two differing heated mixtures are provided simultaneously and/or sequentially onto the substrate/subassembly, thereby forming a single layer comprised at least in part of a mixture of the at least two differing heated mixtures. In this embodiment, a golf ball of the invention incorporates a layer wherein heated mixture $P_{cs}$ may be propelled onto the outermost surface simultaneously with at least one different heated mixture $P_{cs'}$ such that $P_{cs}$ at least partially mixes with or otherwise blends with $P_{cs'}$ when forming $T_{mpl}$. In this embodiment, the resulting layer is comprised of a heterogeneous composition and can consist of targeted discrete areas/locations comprised solely of mixture $P_{cs}$, comprised solely of mixture $P_{cs'}$, and/or comprised of numerous blends consisting of targeted wt. % ratios of $P_{cs}$, to $P_{cs'}$.

Advantageously, in a golf ball of the invention, the differing materials are intermingled in a single layer without the need to eliminate a boundary between two distinct layers as in Hebert's prior golf balls, wherein intermingling of two materials was solely dependent on melt flow rates of differing materials. In one embodiment of such a golf ball of the invention, the resulting $T_{mpl}$ may have a uniform thickness T and comprise $P_{cs}$ and $P_{cs'}$ in a wt. % ratio $P_{cs}$:$P_{cs'}$ that varies throughout T. For example, $T_{mpl}$ may in one embodiment comprise $P_{cs}$ and $P_{cs'}$ in a wt. % ratio $P_{cs}$:$P_{cs'}$ that varies, for example, from about 1:20 to about 20:1 throughout T. Alternatively, $T_{mpl}$ may have a uniform thickness T but comprise $P_{cs}$ and $P_{cs'}$ in a wt. % ratio $P_{cs}$:$P_{cs'}$ that does not vary but instead is constant throughout T.

Alternatively, $T_{mpl}$ may have a non-uniform thickness T' and comprise $P_{cs}$ and $P_{cs'}$ in a wt. % ratio that varies throughout T'. $T_{mpl}$ may in a different embodiment have a non-uniform thickness r and comprise $P_{cs}$ and $P_{cs'}$ in a wt. % ratio that does not vary but instead is constant throughout T.

A resulting layer in an embodiment involving multiple heated mixtures $P_{cs}$, $P_{cs'}$, etc. comprises a heterogeneous composition, each heated mixture having been propelled onto the substrate/subassembly in a coordinated and designed or targeted fashion in order to create a resulting layer consisting of discrete areas/locations comprised of at least one of: solely heated mixture $P_{cs}$, solely heated mixture $P_{cs'}$, and/or mixtures/ratios $P_{cs}$:$P_{cs'}$ thereof.

Figure 3:
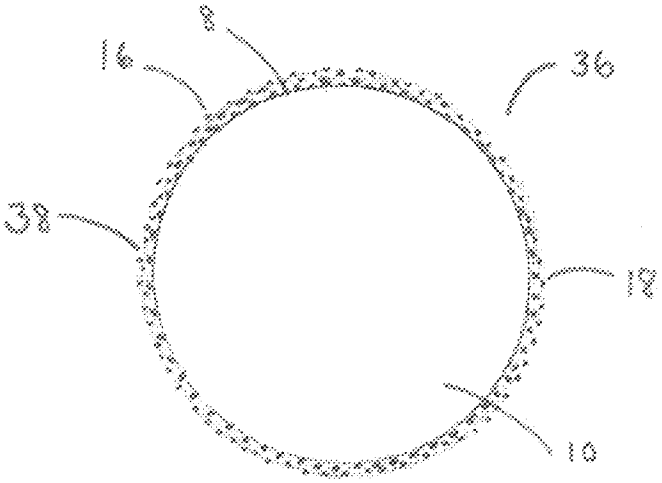
FIG. 3 depicts a side view of a subassembly having a layer $T_{mpl}$ formed thereabout wherein $T_{mpl}$ results from heated mixture $P_{cs}$ being propelled onto the outermost surface.

In this fashion, a golf ball can be formed incorporating a single layer having any thickness and/or comprised of a heterogeneous composition without the aforementioned drawbacks. Layer thickness and/or degree of heterogeneity and/or the pattern of heterogeneity within the layer can be varied for example by any or all of the following: controlling the application rate (heavy application, light application, tapered application, etc.) and/or spray gun angle for each heated mixture; rotating or fixing the subassembly/substrate in relation to the heated mixture being propelled; increasing/decreasing the number of different heated mixtures $P_{cs}$, $P_{cs'}$, etc. being propelled onto the surface;

FIGS. 1, 2 and 3 illustrate of some of the features of a golf ball of the invention and methods for forming same. FIG. 1 depicts system 2 having applicators 3, 5 wherein two differing heated mixtures 4, 6 are propelled/directed/provided onto outer surface 8 of golf ball subassembly 10 while golf ball subassembly 10 is spun on spindles 12 of unit 14 or is otherwise rotated. Heated mixtures 4, 6 are formed when polymeric particles 16, 18 combine with heated fluids 20, 22 as each is urged onto outer surface 8. In this regard, polymeric particles 16, 18 are propelled through and out of channels 24, 26 while heated fluids 20, 22 are urged from compartments 28, 30. Compartments 28, 30 surround but do not access channels 24, 26. Polymeric particles 16, 18 begin to soften, melt or otherwise become reactive upon contacting and/or combining with heated fluids 20, 22 and forming heated mixtures 4, 6. Heated fluids 20, 22 are heated within compartments 28, 30, which do not contact polymeric particles 16, 18 since compartments 28, 30 surround but do not access channels 24, 26. In the embodiment, shown in FIG. 1, polymeric particles 16 are larger than polymeric particles 18.

FIG. 1 demonstrates that multiple differing heated mixtures may be propelled onto the outer surface of a subassembly to form a resulting heterogeneous layer/coating about outer surface 8 comprised of differing materials such as polymeric particles 16, 18. Many desired golf ball characteristics can easily be achieved by modifying and coordinating, for example: the relative amounts of polymeric particles 16, 18 mixed with heated fluids 20, 22; and/or the relative pressures/speeds with which heated mixtures 4, 6 are propelled onto outer surface; and/or how subassembly 10 is rotated with respect to system 2 (or how applicators 3, 5 are positioned with respect to outer surface 8 while heated mixtures 4, 6 are propelled onto outer surface 8.

In one embodiment, heated mixture 4 may be propelled onto the outermost surface simultaneously with at least one different heated mixture heated mixture 6 such that heated polymeric particles 16 of mixture 4 at least partially mixes or blends with polymeric particles 18 to form $T_{mpl}$. $T_{mpl}$ may have a uniform thickness T and comprise polymeric particles 16 and 18 in a ratio that varies throughout T. Alternatively, $T_{mpl}$ may have a non-uniform thickness T' and comprise polymeric particles 16 and 18 in a wt. % ratio $P_{cs}$:$P_{cs'}$ that varies throughout T'.

The inventive methods for making golf balls of the invention are easily and cost effectively usable/adaptable in any inline coating-like process for spraying out material. It is understood that system 2 of FIG. 1 (and system 40 of FIG. 4 below) are general examples of many different possible spraying arrangements for forming a golf ball according to a method of the invention. For example, in an alternative embodiment, golf ball subassembly 8 can be at least temporarily stationary while differing heated mixtures 4, 6 are propelled, directed, and/or provided onto surface 8 of golf ball subassembly 10.

It is of course envisioned that two heated fluids such as 20 and 22 may be substantially similar or alternatively differ in some non-limiting respect such as state (gas versus liquid, etc.).

FIG. 2 illustrates one possible golf ball 32 layered via the system depicted in FIG. 1 wherein a heterogeneous single layer 34 is created about outer surface 8 of golf ball subassembly 10 comprised of two differing heated mixtures wherein particles 16 are larger than polymeric particles 18. In this way, heterogeneous single layer 34 may advantageously include particles 16 and 18 in any desired spatial arrangement without damaging either the layer material itself (polymeric particles 16, 18) or outer surface 8.

FIG. 3 illustrates an alternative inventive golf ball 36 having a heterogeneous single layer 38 is created about outer surface 8 of golf ball subassembly 10 wherein polymeric particles 16 and 18 have substantially similar sizes but yet differ in some other respect or property such as density, etc. That is, polymeric particles 16 and 18 may in some embodiments have similar or identical diameters/sizes yet differ in some other regard.

Figure 4:
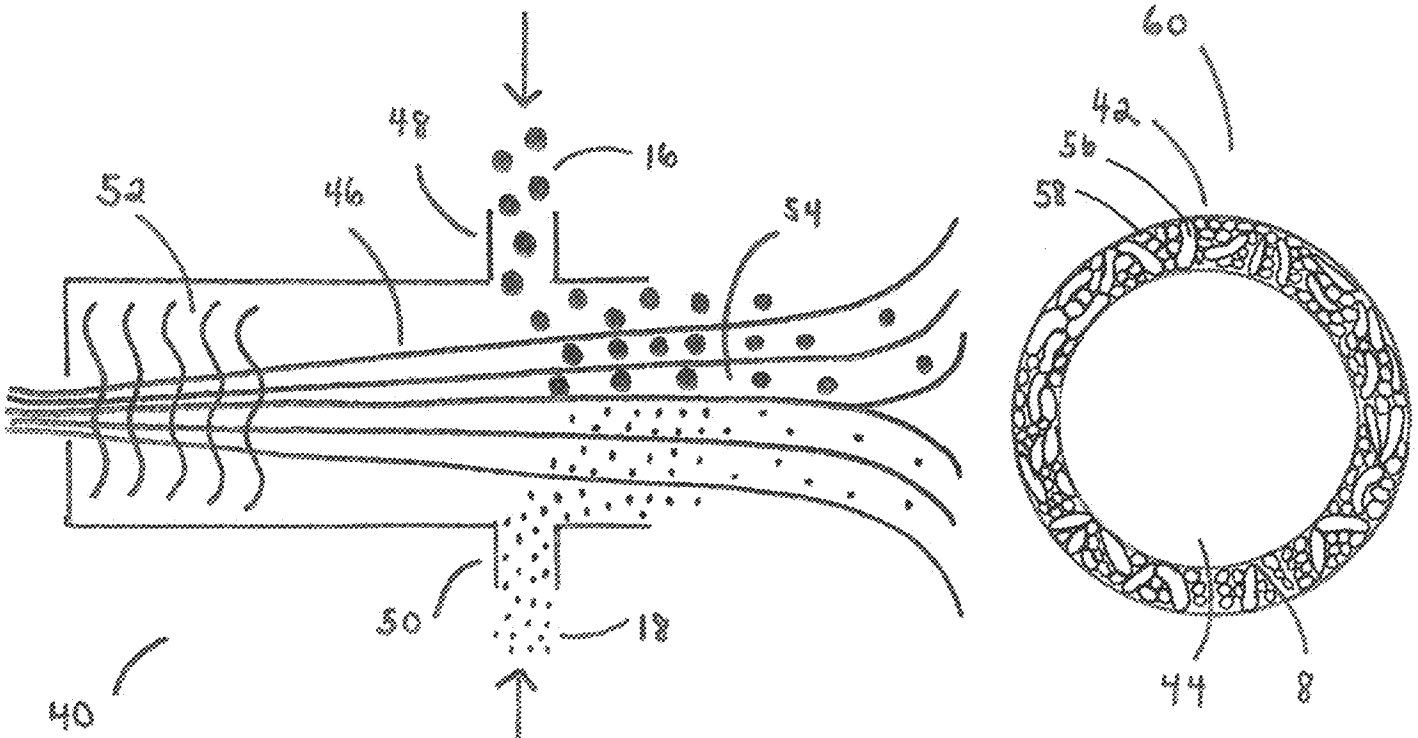
FIG. 4 depicts a side view of another system for forming layer $T_{hmpl}$ about a golf ball subassembly, comprised of a heterogeneous composition of two differing heated mixtures $P_{cs}$ and $P_{cs'}$.

FIG. 4 depicts yet another system 40 wherein a heterogeneous resulting coating/layer 42 is formed about surface 8 of subassembly 44 when polymeric particles 16 and 18 are separately fed into a single stream of heated fluid 46 within system 40 through ports/channels 48, 50 such that polymeric particles 16 and 18 do not contact heat source 52 which heats heated fluid 46. Heated fluid 46 and polymeric particles 16, 18 mix, thereby forming heated mixture 54, which is propelled onto outer surface 8 as polymeric particles 16, 18 soften, melt and/or become reactive. Advantageously, the resulting layer/coating 42 that is formed onto outer surface 8 of golf ball subassembly 44 can be heterogeneous throughout the entire thickness of resulting layer/coating 52 if desired, incorporating the unique properties offered by each of polymers 16 and 18 throughout resulting heterogeneous layer/coating 42.

Heterogeneous layer/coating 42 is comprised of portions 56 and 58, wherein portion 56 represents the polymer of polymeric particles 16 and portion 58 represents the polymer of polymeric particles 18. In FIG. 4, portions 56 and 58 of resulting layer/coating 42 appear particle-like only to illustrate the heterogeneity throughout resulting layer/coating 42. In resulting golf ball 60, layer/coating 42 comprises a heterogeneous blend comprised of portions 56 and 58 throughout the entire thickness of layer/coating/film 42.

Many desired golf ball characteristics can be targeted and achieved easily and cost effectively within a single layer/coating by modifying, for example, the timing and/or concentration of the polymeric particles being propelled within a heated mixture onto outer surface 8. Coordinating, the following, for example, is possible: the relative amounts of polymeric particles 16, 18 mixed with heated fluids 46; and/or the relative pressures/speeds with which heated mixture 50 is propelled onto outer surface; and/or how subassembly 10 is rotated with respect to system 40 (or how applicators 3, 5 are positioned with respect to outer surface 8 while heated mixture 54 is propelled onto outer surface 8).

And the fluid itself may comprise one or more states such as gas, etc., and may be heated by at least one of any suitable heating means such as by electricity, heated gas, etc.

Figure 5:
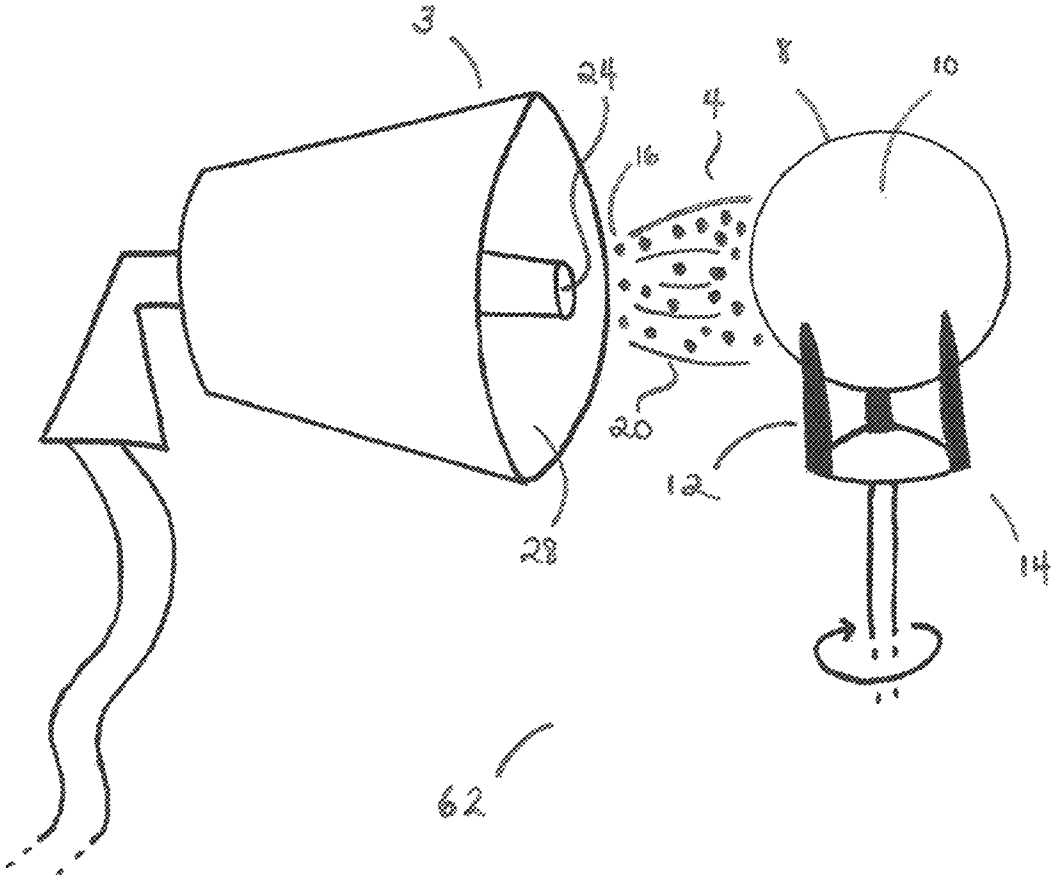
FIG. 5 depicts a side view of a system for forming layer $T_{mpl}$ about a golf ball subassembly such as depicted in FIG. 3.
Figure 6:
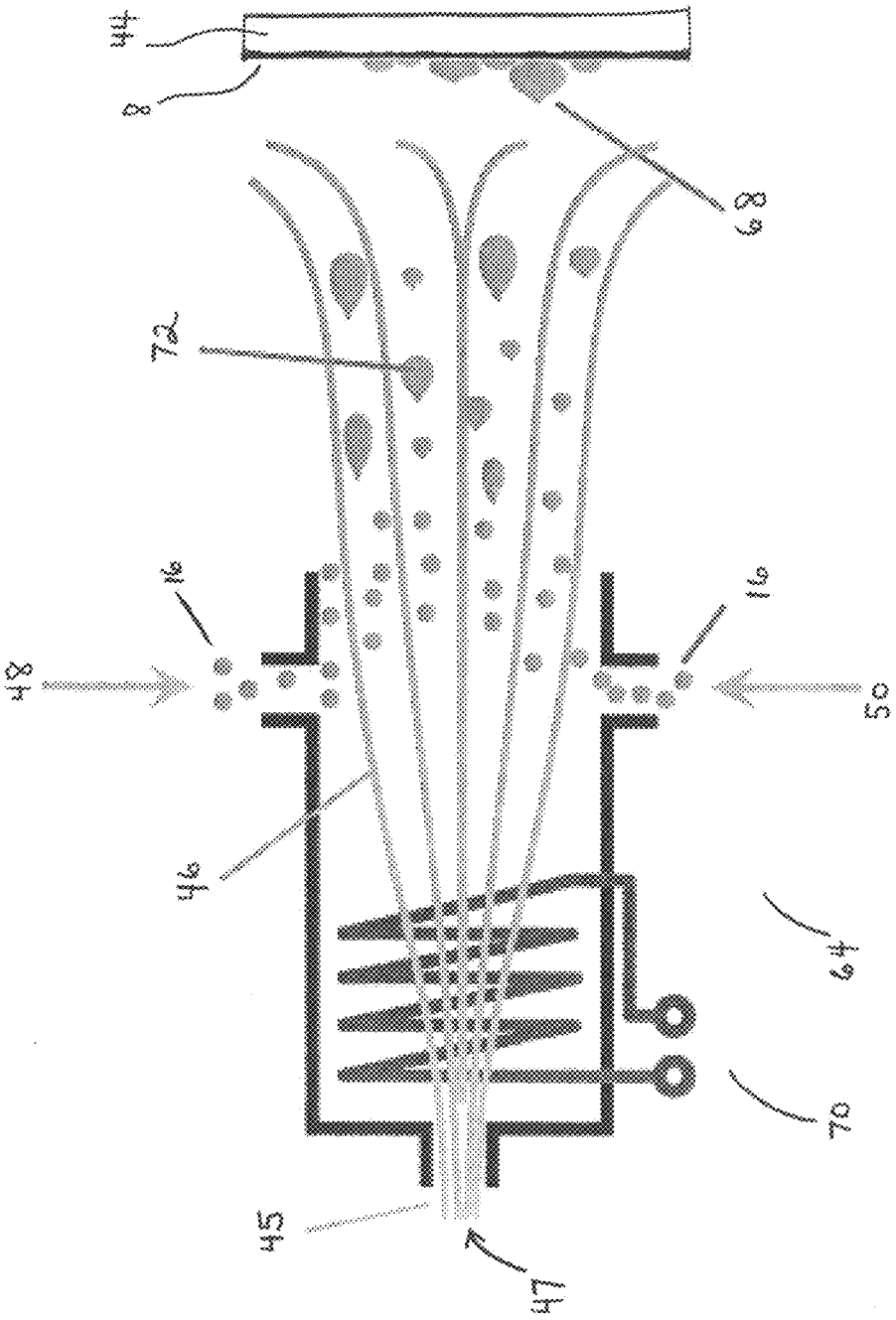
FIG. 6 depicts a side view of yet another system for forming layer $T_{mpl}$ about a golf ball subassembly such as depicted in FIG. 3.

FIG. 5 and FIG. 6 depict embodiments wherein a single heated mixture is propelled/directed/provided onto outer surface 8. In FIG. 5, system 62 has applicator 3 wherein heated mixture 4 is propelled/directed/provided onto outer surface 8 of golf ball subassembly 10 while golf ball subassembly 10 is spun on spindles 12 of unit 14 or is otherwise rotated. Heated mixture 4 is formed when substantially similar polymeric particles 16 combine with heated fluid 20 and urged onto outer surface 8. In this regard, polymeric particles 16 are propelled through and out of channel 24 while heated fluid 20 is urged from compartment 28. Compartment 28 surrounds but does not access channel 24. Polymeric particles 16 begin to soften, melt or otherwise become reactive upon contacting and/or combining with heated fluid 20 and forming heated mixture 4. Heated fluid 20 is heated within compartment 28, which does not contact polymeric particles 16 since compartment 28 surrounds but does not access channel 24. In the embodiment shown in FIG. 5, polymeric particles 16 are substantially similar. Polymeric particles 16 can at least partially interact with outer surface 8 when heated mixture 4 contacts outer surface 8.

FIG. 6, meanwhile, depicts a different system 64 for propelling/directing/providing a heated mixture comprised of substantially similar polymeric particles about the outer surface. In system 64, a resulting coating/layer 68 is formed about surface 8 of subassembly 44 when polymeric particles 16 are fed into a single stream of heated fluid 46 within system 64 through ports/channels 48, 50 such that polymeric particles 16 do not contact heat source 70 which heats heated fluid 46. Heated fluid originates as fluid 45, introduced into system 64 through channel 47. Heated fluid 46 and polymeric particles 16 mix, thereby forming heated mixture 72, which is propelled onto outer surface 8 as polymeric particles 16 soften, melt and/or become reactive. Advantageously, the resulting layer/coating/film 68 forms onto outer surface 8 of golf ball subassembly 44 with optimized properties and without damage to or modification of the layer material since polymeric particles 16 never contact heat source 70. Polymeric particles 16 can at least partially interact with outer surface 8 when heated mixture 72 contacts outer surface 8.

The following examples illustrate how a layer/coating/film having any thickness can be incorporated in a golf ball without the problems of previous golf balls discussed herein and how the softening/melting/reacting temperatures of polymeric particles and outer surface of a subassembly may be advantageously coordinated in a golf ball of the invention in order to optimize properties and minimize damage to the layer material and/or the material of outer surface when the layer material is provided/propelled about/onto the outer surface.

In this regard, a trial was conducted wherein the following subassemblies were layered/coated/filmed as follows:

1) at least four 1.550" polybutadiene cores were mounted on a conventional tri-pod stand and entire surface of each core sprayed with ~35-40 mils of ResoCoat™ 301 polyethylene based thermoplastic coating that could replace 1.620" cups with a similar but sprayed material;

2) at least four 1.620" cups, 2 identical parts per core, were held in a common holding stand and sprayed with ~35-45 mils ResoCoat™ 301 that could be a thin golf ball layer formed about the outer surface of a cased core prior to the compression molding step;

3) at least four 1.580" cores were mounted on a conventional tri-pod stand and entire outer surfaces sprayed with thin (<10 mils) layer that could serve as a low water-vapor transmission rate (MVTR) coating providing protection to the core from undesirable moisture penetration;

4) two 1.68" dimpled cavities were masked at the mold edge with heat resistant materials to prevent material deposition on the mold body. The interiors were then sprayed with ResoCoat™ 301 to explore forming a cover layer in the mold rather than on the core, during the compression molding step; and 5) at least four 1.68" molded balls were mounted on a conventional tri-pod stand and entire outer surfaces sprayed with layer of ResoCoat™ 301 for creating an outer most surface of the golf ball.

During the trial, ResoCoat™ 301, a polyethylene based, polymer thermal spray (PTS) powder was used as the polymeric mixture. ResoCoat™ 301 is similar in material composition to Surlyn® ionomers, conventionally used in golf ball constructions. ResoCoat™ 301 was used at the 140 mesh sieve level, which is a very fine particle size. This size was selected to maximize smooth and even coating when forming a thin layer.

The system used for heating the fluid (electrical heat source), mixing the heated fluid (hot gas) with the polymeric mixture, and propelling the heated mixture onto each surface was Resodyn PTS 5—5 kW electric deposition PTS system (PTS standing for "polymer thermal spray" and the number 5 representing the 5 kW of energy that the electric version of the system generates). This particular model was specifically selected due to the small and potentially tight spaces to be sprayed, and also to attempt to provide better heat control for the application technician. See also, U.S. Pat. No. 8,857,733 to Galbraith et al., assigned to Resodyn Corporation and hereby incorporated by reference herein in its entirety.

Observations are reported in TABLE I for each group as follows:

TABLE I

TRIAL RESULTS

| | Thickness of Layer/Coating/Film and Type of Substrate | | | | |
|---|---|---|---|---|---|
| Observations | 35-45 Mils ResoCoat ™ 301 layers about 1.550 in. Polybutadiene cores | 30-45 mils ResoCoat ™ 301 layer about outer surface of Surlyn casing cups (1.620 in.) | <10 Mils ResoCoat ™ 301 layer about 1.580 in. Polybutadiene Cores | 15-40 mils In-mold ResoCoat ™ 301 Layer On 1.68 in. Dimpled Cavity | Thinnest Possible Surface coat of ResoCoat ™ 301 about Surface of NXT Tour Fusablend ® Cover |
| 1 | Successfully formed even and consistent layer/coating having thickness of 35 mils across the core surface. | Failures ocurred where temperature of ResoCoat ™ 301 material was at or greater than softening, melting, reacting temperatures of the surface of casing cups being coated. | Successfully formed layer/ coating having thickness of 6.5-7.5 mils directly onto surface of core as possible vapor barrier layer. | Successfully formed layer/ coating having thickness of 18-23 mils directly into surface of cavity. | Molding artifacts revealed where temperature of ResoCoat ™ 301 material > softening, melting, reacting temperatures of surface of NXT Tour Fusablend ® Cover. |
| 2 | Successfully formed even and consistent layer/coating having thickness of 42.5 mils across the core surface | — | — | Successfully formed layer/ coating having thickness of 31-46 mils directly into surface of cavity. | Creating a blasted layer coating possible where temperature of_coating material is less than softening, melting, reacting temperatures of the surface being coated. |

TABLE I-continued

| TRIAL RESULTS | | | | | |
|---|---|---|---|---|---|
| | Thickness of Layer/Coating/Film and Type of Substrate | | | | |
| Observations | 35-45 Mils ResoCoat ™ 301 layers about 1.550 in. Polybutadiene cores | 30-45 mils ResoCoat ™ 301 layer about outer surface of Surlyn casing cups (1.620 in.) | <10 Mils ResoCoat ™ 301 layer about 1.580 in. Polybutadiene Cores | 15-40 mils In-mold ResoCoat ™ 301 Layer On 1.68 in. Dimpled Cavity | Thinnest Possible Surface coat of ResoCoat ™ 301 about Surface of NXT Tour Fusablend ® Cover |
| 3 | — | — | — | Successfully formed layer/ coating having thickness of 30-50 mils directly into surface of cavity. | — |

As shown in TABLE I, even and consistent layers having thicknesses of about 35-45 mils were successfully formed across the thermoset core surfaces when the spray composition was not exposed to the heating source. Additionally, application of very thin layers having thickness of 6.5-7.5 mils, which can be particularly useful as a vapor barrier layer, formed directly onto cased core surfaces. In each of these instances, the applicator mixed heated gas and fluidized polymer powder. The heat source for heating the air did not contact the polymer powder, thereby eliminating damage to the polymer powder as it forms the heated mixture with the heated air and is propelled onto the core surface being layered/coated/filmed.

Notably, spraying a heated mixture about thermoplastic casing cups required the heated mixture to have a temperature lower than the softening, melting, reacting temperature of the surface of the thermoplastic casing cups being layered/coated/filmed where $T_{mpl}$ or $T_{hmpl}$ is an outermost layer otherwise, deformations resulting in the thermoplastic cups being coated/layered/filmed will be obvious to the purchaser.

Spraying the layer within the cavity desirably preserved mold shape integrity and also retained the mold pattern cleanly. Advantageously, thickness of the material had no effect on the pattern retention or duplication.

Varying the spray angle was found to vary layer thickness. For example, changing spray angle from directly overhead into the bottom of the cavity produced heavier deposition in the bottom of the cavity. Meanwhile, changing spray angle from directly overhead to along the side of the cavity wall deposited more material along the walls. Inspection of the plastic cups indicated thickness variability from the top of the dome to the edges. This variation may increase mold efficiency when heat and pressure are applied. Based on the results, the ability to apply any number of layers of differing layers within a mold is possible.

During the initial stage of coating blasted balls, the seam line of the molded shells quickly became apparent. The thermoplastic cups used to create the molded and blasted cover were apparently susceptible to the same heat limitations of the raw cups. Accordingly, in at least some applications, the layer/coating/film material and/or substrate should be each selected such that the layer/coating/film material has a lower softening/melting/reacting temperature than that of the surface of the substrate. In such cases, deformation of the surface of the substrate can be avoided if the layer/coating/film material (heated mixture) has a lower softening/melting/reacting temperature than that of the surface of the substrate being coated or layered (subassembly).

Thus, the layered/coated/filmed subassemblies formed herein present a significant and unexpected improvement over golf balls incorporating layers/coatings/films formed via conventional thermal spray methods wherein both the polymeric powder and the subassemblies being coated/layered/filmed are in contact with the heat source. It should be understood that the terms layer, coating, and film are used herein interchangeably.

And multiple different heated mixtures can be propelled simultaneously or sequentially to form a single layer comprised of both heated mixtures in order to target desired properties/playing characteristics in a golf ball incorporating such a layer/coating/film.

Golf balls of this invention may meanwhile incorporate any number of other golf ball layers that are comprised of conventional golf ball layer compositions for example, ionomers, polyurethanes, polyureas, TPE, HNP, crosslinked rubber, etc., or blends/mixtures/combinations thereof.

Suitable layer compositions are disclosed, for example, in U.S. Pat. Nos. 6,953,820 and 6,939,907, and U.S. Pat. Nos. 5,919,100, 6,653,382, 6,872,774, 7,074,137, and 7,300,364, the entire disclosures of which are hereby incorporated herein by reference.

Suitable rubber compositions include a base rubber selected from natural and synthetic rubbers, including, but not limited to, polybutadiene, polyisoprene, ethylene propylene rubber ("EPR"), ethylene propylene diene rubber ("EPDM"), styrene butadiene rubber, styrenic block copolymer rubber, butyl rubber, halobutyl rubber, copolymers of isobutylene and para-alkylstyrene, halogenated copolymers of isobutylene and para-alkylstyrene, acrylonitrile butadiene rubber, polychloroprene, alkyl acrylate rubber, chlorinated isoprene rubber, acrylonitrile chlorinated isoprene rubber, polystyrene elastomers, polyethylene elastomers, polyurethane elastomers, polyurea elastomers, metallocene-catalyzed elastomers and plastomers, polyalkenamer, phenol formaldehyde, melamine formaldehyde, polyepoxide, polysiloxane, alkyd, polyisocyanurate, polycyanurate, polyacrylate, and combinations of two or more thereof. Diene rubbers are preferred, particularly polybutadiene, styrene butadiene, acrylonitrile butadiene, and mixtures of polybutadiene with other elastomers wherein the amount of polybutadiene present greater than 40 wt % based on the total polymeric weight of the mixture.

Non-limiting examples of suitable commercially available base rubbers are Buna CB high-cis neodymium-catalyzed polybutadiene rubbers, such as Buna CB 23, Buna CB24, and Buna CB high-cis cobalt-catalyzed polybutadiene rubbers, such as Buna CB 1203, 1220 and 1221, commercially available from Lanxess Corporation; SE BR-1220, commercially available from The Dow Chemical Company; Europrene® NEOCIS® BR 40 and BR 60, commercially available from Polimeri Europa®; UBEPOL-BR® rubbers, commercially available from UBE Industries, Inc.; BR 01, commercially available from Japan Synthetic Rubber Co., Ltd.; Neodene high-cis neodymium-catalyzed polybutadiene rubbers, such as Neodene BR 40, commercially available from Karbochem; TP-301 transpolyisoprene, commercially available from Kuraray Co., Ltd.; Vestenamer® polyoctenamer, commercially available from Evonik Industries; Butyl 065 and Butyl 288 butyl rubbers, commercially available from ExxonMobil Chemical Company; Butyl 301 and Butyl 101-3, commercially available from Lanxess Corporation; Bromobutyl 2224 and Chlorobutyl 1066 halobutyl rubbers, commercially available from ExxonMobil Chemical Company; Bromobutyl X2 and Chlorobutyl 1240 halobutyl rubbers, commercially available from Lanxess Corporation; BromoButyl 2255 butyl rubber, commercially available from Japan Synthetic Rubber Co., Ltd.; Vistaion® 404 and Vistaion® 706 ethylene propylene rubbers, commercially available from ExxonMobil Chemical Company; Dutral CO 058 ethylene propylene rubber, commercially available from Polimeri Europa; Nordel® IP NDR 5565 and Nordel® IP 3670 ethylene-propylene-diene rubbers, commercially available from The Dow Chemical Company; EPT1045 and EPT1045 ethylene-propylene-diene rubbers, commercially available from Mitsui Corporation; Buna SE 1721 TE styrene-butadiene rubbers, commercially available from Lanxess Corporation; Afpol 1500 and Afpol 552 styrene-butadiene rubbers, commercially available from Karbochem; Plioflex PLF 1502, commercially available from Goodyear Chemical; Nipol® DN407 and Nipol® 1041L acrylonitrile butadiene rubbers, commercially available from Zeon Chemicals, L.P.; Neoprene GRT and Neoprene AD30 polychloroprene rubbers; Vamac® ethylene acrylic elastomers, commercially available from E. I. du Pont de Nemours and Company; Hytemp® AR12 and AR214 alkyl acrylate rubbers, commercially available from Zeon Chemicals, L.P.; Hypalon® chlorosulfonated polyethylene rubbers, commercially available from E. I. du Pont de Nemours and Company; and Goodyear Budene® 1207 polybutadiene, commercially available from Goodyear Chemical. In a particular embodiment, the core is formed from a rubber composition comprising as the base rubber a blend of Neodene BR 40 polybutadiene, Budene® 1207 polybutadiene, and Buna SB 1502 styrene butadiene rubber. In another particular embodiment, the core is formed from a rubber composition comprising as the base rubber a blend of Neodene BR 40 polybutadiene, Buna CB 1221, and core regrind.

The rubber is crosslinked using, for example, a peroxide or sulfur cure system, C—C initiators, high energy radiation sources capable of generating free radicals, or a combination thereof. The rubber composition optionally includes one or more of the following: scorch retarder, antioxidant, soft and fast agent, filler, processing aid, processing oil, coloring agent, fluorescent agent, chemical blowing and foaming agent, defoaming agent, stabilizer, softening agent, impact modifier, free radical scavenger, and antiozonant (e.g., p-phenylenediames). Suitable types and amounts of rubber, initiator agent, coagent, filler, and additives are more fully described in, for example, U.S. Pat. Nos. 6,566,483, 6,695,718, 6,939,907, 7,041,721 and 7,138,460, the entire disclosures of which are hereby incorporated herein by reference. Particularly suitable diene rubber compositions are further disclosed, for example, in U.S. Pat. No. 7,654,918, the entire disclosure of which is hereby incorporated herein by reference.

Suitable ionomer compositions include partially neutralized ionomers and highly neutralized ionomers, including ionomers formed from blends of two or more partially neutralized ionomers, blends of two or more highly neutralized ionomers, and blends of one or more partially neutralized ionomers with one or more highly neutralized ionomers. Preferred ionomers are salts of O/X- and O/X/Y-type acid copolymers, wherein O is an α-olefin, X is a $C_3$-$C_8$ α,β-ethylenically unsaturated carboxylic acid, and Y is a softening monomer. O is preferably selected from ethylene and propylene. X is preferably selected from methacrylic acid, acrylic acid, ethacrylic acid, crotonic acid, and itaconic acid. Methacrylic acid and acrylic acid are particularly preferred. As used herein, "(meth) acrylic acid" means methacrylic acid and/or acrylic acid. Likewise, "(meth) acrylate" means methacrylate and/or acrylate. Y is preferably selected from (meth) acrylate and alkyl (meth) acrylates wherein the alkyl groups have from 1 to 8 carbon atoms, including, but not limited to, n-butyl (meth) acrylate, isobutyl (meth) acrylate, methyl (meth) acrylate, and ethyl (meth) acrylate. Particularly preferred O/X/Y-type copolymers are ethylene/(meth) acrylic acid/n-butyl (meth) acrylate, ethylene/(meth) acrylic acid/isobutyl (meth) acrylate, ethylene/(meth) acrylic acid/methyl (meth) acrylate, and ethylene/(meth) acrylic acid/ethyl (meth) acrylate. The acid is typically present in the acid copolymer in an amount of 6 wt % or greater, or 9 wt % or greater, or 10 wt % or greater, or 11 wt % or greater, or 15 wt % or greater, or 16 wt % or greater, or 19 wt % or greater, or 20 wt % or greater, or in an amount within a range having a lower limit of 1 or 4 or 6 or 8 or 10 or 11 or 12 or 15 wt % and an upper limit of 15 or 16 or 17 or 19 or 20 or 20.5 or 21 or 25 or 30 or 35 or 40 wt %, based on the total weight of the acid copolymer. The acid copolymer is at least partially neutralized with a cation source, optionally in the presence of a high molecular weight organic acid, such as those disclosed in U.S. Pat. No. 6,756,436, the entire disclosure of which is hereby incorporated herein by reference. In a particular embodiment, less than 40% of the acid groups present in the composition are neutralized. In another particular embodiment, from 40% to 60% of the acid groups present in the composition are neutralized. In another particular embodiment, from 60% to 70% of the acid groups present in the composition are neutralized. In another particular embodiment, from 60% to 80% of the acid groups present in the composition are neutralized. In another particular embodiment, from 70% to 80% of the acid groups present in the composition are neutralized. In another embodiment, from 80% to 100% of the acid groups present in the composition are neutralized. Suitable cation sources include, but are not limited to, metal ion sources, such as compounds of alkali metals, alkaline earth metals, transition metals, and rare earth elements; ammonium salts and monoamine salts; and combinations thereof. Preferred cation sources are compounds of magnesium, sodium, potassium, cesium, calcium, barium, manganese, copper, zinc, tin, lithium, and rare earth metals. In a particular embodiment, the ionomer composition includes a bimodal ionomer, for example, DuPont® AD1043 ionomers, and the ionomers disclosed in U.S. Pat. No. 7,037,967 and U.S. Pat. Nos. 6,562,906, 6,762,246 and 7,273,903, the entire disclosures of which are hereby incorporated herein by reference. Suitable ionomers are further disclosed, for example, in U.S. Pat. Nos. 5,587,430, 5,691,418, 5,866,658, 6,100,321, 6,653,382, 6,756,436, 6,777,472, 6,815,480, 6,894,098, 6,919,393, 6,953,820, 6,994,638, 7,230,045, 7,375,151, 7,429,624, and 7,652,086, the entire disclosures of which are hereby incorporated herein by reference.

Suitable ionomer compositions also include blends of one or more partially- or fully-neutralized polymers with additional thermoplastic and thermoset materials, including, but not limited to, non-ionomeric acid copolymers, engineering thermoplastics, fatty acid/salt-based highly neutralized polymers, polybutadienes, polyurethanes, polyureas, polyesters, polyamides, polycarbonate/polyester blends, thermoplastic elastomers, maleic anhydride-grafted metallocene-catalyzed polymers (e.g., maleic anhydride-grafted metallocene-catalyzed polyethylene), and other conventional polymeric materials.

Suitable ionomeric compositions are further disclosed, for example, in U.S. Pat. Nos. 6,653,382, 6,756,436, 6,777,472, 6,894,098, 6,919,393, and 6,953,820, the entire disclosures of which are hereby incorporated herein by reference.

Also suitable are polyester ionomers, including, but not limited to, those disclosed, for example, in U.S. Pat. Nos. 6,476,157 and 7,074,465, the entire disclosures of which are hereby incorporated herein by reference.

Also suitable are thermoplastic elastomers comprising a silicone ionomer, as disclosed, for example, in U.S. Pat. No. 8,329,156, the entire disclosure of which is hereby incorporated herein by reference.

Also suitable are the following non-ionomeric polymers, including homopolymers and copolymers thereof, as well as their derivatives that are compatibilized with at least one grafted or copolymerized functional group, such as maleic anhydride, amine, epoxy, isocyanate, hydroxyl, sulfonate, phosphonate, and the like:

(a) polyesters, particularly those modified with a compatibilizing group such as sulfonate or phosphonate, including modified poly(ethylene terephthalate), modified poly(butylene terephthalate), modified poly(propylene terephthalate), modified poly(trimethylene terephthalate), modified poly(ethylene naphthenate), and those disclosed in U.S. Pat. Nos. 6,353,050, 6,274,298, and 6,001,930, the entire disclosures of which are hereby incorporated herein by reference, and blends of two or more thereof;

(b) polyamides, polyamide-ethers, and polyamide-esters, and those disclosed in U.S. Pat. Nos. 6,187,864, 6,001,930, and 5,981,654, the entire disclosures of which are hereby incorporated herein by reference, and blends of two or more thereof;

(c) polyurethanes, polyureas, polyurethane-polyurea hybrids, and blends of two or more thereof;

(d) fluoropolymers, such as those disclosed in U.S. Pat. Nos. 5,691,066, 6,747,110 and 7,009,002, the entire disclosures of which are hereby incorporated herein by reference, and blends of two or more thereof;

(e) non-ionomeric acid polymers, such as E/X- and E/X/Y-type copolymers, wherein E is an olefin (e.g., ethylene), X is a carboxylic acid such as acrylic, methacrylic, crotonic, maleic, fumaric, or itaconic acid, and Y is an optional softening comonomer such as vinyl esters of aliphatic carboxylic acids wherein the acid has from 2 to 10 carbons, alkyl ethers wherein the alkyl group has from 1 to 10 carbons, and alkyl alkylacrylates such as alkyl methacrylates wherein the alkyl group has from 1 to 10 carbons; and blends of two or more thereof;

(f) metallocene-catalyzed polymers, such as those disclosed in U.S. Pat. Nos. 6,274,669, 5,919,862, 5,981,654, and 5,703,166, the entire disclosures of which are hereby incorporated herein by reference, and blends of two or more thereof;

(g) polystyrenes, such as poly(styrene-co-maleic anhydride), acrylonitrile-butadiene-styrene, poly(styrene sulfonate), polyethylene styrene, and blends of two or more thereof;

(h) polypropylenes and polyethylenes, particularly grafted polypropylene and grafted polyethylenes that are modified with a functional group, such as maleic anhydride of sulfonate, and blends of two or more thereof;

(i) polyvinyl chlorides and grafted polyvinyl chlorides, and blends of two or more thereof;

(j) polyvinyl acetates, preferably having less than about 9% of vinyl acetate by weight, and blends of two or more thereof;

(k) polycarbonates, blends of polycarbonate/acrylonitrile-butadiene-styrene, blends of polycarbonate/polyurethane, blends of polycarbonate/polyester, and blends of two or more thereof;

(l) polyvinyl alcohols, and blends of two or more thereof;

(m) polyethers, such as polyarylene ethers, polyphenylene oxides, block copolymers of alkenyl aromatics with vinyl aromatics and poly(amic ester)s, and blends of two or more thereof;

(n) polyimides, polyetherketones, polyamideimides, and blends of two or more thereof;

(o) polycarbonate/polyester copolymers and blends; and (p) combinations of any two or more of the above thermoplastic polymers.

Examples of commercially available thermoplastics suitable for forming thermoplastic layers include, but are not limited to, Pebax® thermoplastic polyether block amides, commercially available from Arkema Inc.; Surlyn® ionomer resins, Hytrel® thermoplastic polyester elastomers, and ionomeric materials sold under the trade names DuPont® HPF 1000, HPF 2000, HPF AD 1035, HPF AD 1040, all of which are commercially available from E. I. du Pont de Nemours and Company; Iotek® ionomers, commercially available from ExxonMobil Chemical Company; Amplify® IO ionomers of ethylene acrylic acid copolymers, commercially available from The Dow Chemical Company; Clarix® ionomer resins, commercially available from A. Schulman Inc.; Elastollan® polyurethane-based thermoplastic elastomers, commercially available from BASF; and Xylex® polycarbonate/polyester blends, commercially available from SABIC Innovative Plastics.

Suitable plasticized polymer compositions include a plasticizer in an amount sufficient to substantially change the stiffness and/or hardness of the composition, and typically comprise from 20 to 99.5 wt % of the polymer and from 0.5 to 80 wt % of the plasticizer, based on the combined weight of the polymer and the plasticizer. In a particular embodiment, the plasticizer is present in an amount of 0.5% or 1% or 3% or 5% or 7% or 8% or 9% or 10% or 12% or 15% or 18% or 20% or 22% or 25% or 30% or 35% or 40% or 42% or 50% or 55% or 60% or 66% or 71% or 75% or 80%, by weight based on the combined weight of the polymer and the plasticizer, or the plasticizer is present in an amount within a range having a lower limit and an upper limit selected from these values. Suitable polymers include acid copolymers, partially neutralized acid copolymers, highly neutralized acid polymers ("HNPs"), polyesters, polyamides, thermosetting and thermoplastic polyurethanes.

Suitable plasticized acid copolymer compositions, plasticized partially neutralized acid copolymer compositions, and plasticized HNP compositions, and particularly suitable golf ball constructions utilizing such compositions, are further disclosed, for example, in U.S. Patent Application Publ. No. 2015/0031475, U.S. Patent Application Publ. No. 2015/0005108, U.S. patent application Ser. No. 14/576,800, and U.S. patent application Ser. No. 14/588,317, the entire disclosures of which are hereby incorporated herein by reference.

Suitable plasticized polyester compositions, and particularly suitable golf ball constructions utilizing such compositions, are further disclosed, for example, in U.S. patent application Ser. No. 14/532,141, the entire disclosure of which is hereby incorporated herein by reference.

Suitable plasticized polyamide compositions, and particularly suitable golf ball constructions utilizing such compositions, are further disclosed, for example, in U.S. Patent Application Publ. No. 2014/0302947, U.S. Patent Application Publ. No. 2014/0323243, U.S. Patent Application Publ. No. 20150057105, and U.S. patent application Ser. No. 14/576,324, the entire disclosures of which are hereby incorporated herein by reference.

Suitable plasticized polyurethane compositions, and particularly suitable golf ball constructions utilizing such compositions, are further disclosed, for example, in U.S. patent application Ser. No. 14/672,538, U.S. patent application Ser. No. 14/672,523, U.S. patent application Ser. No. 14/672,485, and U.S. patent application Ser. No. 14/691,720, the entire disclosures of which are hereby incorporated herein by reference. Further suitable plasticized compositions include for example those disclosed in U.S. patent application Ser. Nos. 14/571,610, 14/576,324, and 14/707,028.

And it is contemplated that a golf ball of the invention may have any known construction and have any number of layers with any known properties. In one non-limiting example, a golf ball of the invention may comprise a single core having a diameter of from about 1.20 in. to about 1.65 in. Alternatively, the core may have a dual core arrangement having a total diameter of from about 1.40 in. to about 1.65 in, for example, wherein the inner core may has a diameter of from about 0.75 inches to about 1.30 in. and the outer core has a thickness of from about 0.05 in. to about 0.45 in. Cover thicknesses generally range from about 0.015 in. to about 0.090 inches, although a golf ball of the invention may comprise any known thickness. Meanwhile, casing layers and inner cover layers each typically have thicknesses ranging from about 0.01 in. to about 0.06 in. A golf ball of the invention may also have one or more film layers, paint layers or coating layers having a combined thickness of from about 0.1 μm to about 100 μm, or from about 2 μm to about 50 μm, or from about 2 μm to about 30 μm. Meanwhile, each coating layer may have a thickness of from about 0.1 μm to about 50 μm, or from about 0.1 μm to about 25 μm, or from about 0.1 μm to about 14 μm, or from about 2 μm to about 9 μm, for example.

A golf ball of the invention may further incorporate indicia, which as used herein, is considered to mean any symbol, letter, group of letters, design, or the like, that can be added to the dimpled surface of a golf ball.

It will be appreciated that any known dimple pattern may be used with any number of dimples having any shape or size. For example, the number of dimples may be 252 to 456, or 330 to 392 and may comprise any width, depth, and edge angle. The parting line configuration of said pattern may be either a straight line or a staggered wave parting line (SWPL), for example.

In any of these embodiments the single-layer core may be replaced with a two or more layer core wherein at least one core layer has a hardness gradient. And the cover hardness may be targeted depending on desired playing characteristics. As a general rule, all other things being equal, a golf ball having a relatively soft cover will spin more than a similarly constructed ball having a harder cover.

In the present invention, compression and CoR may also be tailored to suit desired playing characteristics. In this regard, "compression" is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Cores having a very low stiffness will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton, *Compression by Any Other Name, Science and Golf IV, Proceedings of the World Scientific Congress of Golf* (Eric Thain ed., Routledge, 2002) ("J. Dalton").

In a golf ball if the invention, Coefficient of Restitution or COR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. COR is then calculated as the ratio of the outgoing transit time period to the incoming transit time period, $COR=V_{out}/V_{in}=T_{in}/T_{out}$. The COR value can be targeted, for example, by varying the core peroxide and antioxidant types and amounts as well as the cure temperature and duration.

The surface hardness of a golf ball layer is obtained from the average of a number of measurements taken from opposing hemispheres, taking care to avoid making measurements on the parting line of the core or on surface defects such as holes or protrusions. Hardness measurements are made pursuant to ASTM D-2240 "Indentation Hardness of Rubber and Plastic by Means of a Durometer." Because of the curved surface of the golf ball layer, care must be taken to ensure that the golf ball or golf ball subassembly is centered under the durometer indentor before a surface hardness reading is obtained. A calibrated digital durometer, capable of reading to 0.1 hardness units, is used for all hardness measurements. The digital durometer must be attached to and its foot made parallel to the base of an automatic stand. The weight on the durometer and attack rate conforms to ASTM D-2240. It should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other.

It is understood that the golf balls of the invention incorporating at least one treated surface as described and illustrated herein represent only some of the many embodiments of the invention. It is appreciated by those skilled in the art that various changes and additions can be made to such golf balls without departing from the spirit and scope of this invention. It is intended that all such embodiments be covered by the appended claims.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

Although the golf ball of the invention has been described herein with reference to particular means and materials, it is to be understood that the invention is not limited to the particulars disclosed and extends to all equivalents within the scope of the claims.

What is claimed is:

1. A method of manufacturing a golf balls comprising a single layer $T_{hmpl}$ comprised of a heterogeneous thermoset and/or thermoplastic composition, comprising:

providing a subassembly having at least one of an innermost surface or an outermost surface;

providing at least two polymeric mixtures $P_c$ and $P_{c'}$;

wherein polymeric mixture $P_c$ comprises a plurality of particles that differ from a plurality of particles of polymeric mixture $P_{c'}$; and wherein polymeric mixture $P_c$ has a softening, melting and/or reacting temperature $M_p$ and polymeric mixture $P_{c'}$ has a softening, melting and/or reacting temperature $M_{p'}$;

heating at least one fluid, with a heat source that does not contact $P_c$ and $P_{c'}$, to a temperature $M_{ph}$ wherein $M_p \leq M_{ph}$ and $M_{p'} \leq M_{ph}$ to form a heated fluid;

softening, melting and/or reacting the plurality of particles of $P_c$ and $P_{c'}$ by mixing $P_c$ and $P_{c'}$ with the at least one heated fluid to form a heated mixture $P_{cs}$ and a heated mixture $P_{cs'}$; and coordinating/timing propelling of heated mixture $P_{cs}$ and a heated mixture $P_{cs'}$ onto at least one of the innermost surface or the outermost surface to form the single layer $T_{hmpl}$ comprised of a heterogeneous thermoset and/or thermoplastic composition about the outermost surface comprised of the plurality of particles of $P_c$ and $P_{c'}$.

2. The method of forming a golf ball of claim 1, wherein heated mixture $P_{cs}$ and heated mixture $P_{cs'}$ are propelled/directed onto the outer surface separately and propelling of each is timed or coordinated such that heated mixture $P_{cs}$ and heated mixture $P_{cs'}$ at least partially mix onto the outer surface when forming single layer $T_{hmpls}$.

3. The method of forming a golf ball of claim 1, wherein $T_{hmpl}$ has a uniform thickness T and comprises $P_{cs}$ and $P_{cs'}$ in a ratio $P_{cs}:P_{cs'}$ that varies throughout T.

4. The method of forming a golf ball of claim 1, wherein $T_{hmpl}$ has a uniform thickness T and comprises $P_c$ and $P_{c'}$ in a ratio $P_c:P_{c'}$ that varies throughout T.

5. The method of forming a golf ball of claim 1, wherein $T_{hmpl}$ has a non-uniform thickness T and comprises $P_{cs}$ and $P_{cs'}$ in a ratio $P_{cs}:P_{cs'}$ that varies throughout T.

6. The method of forming a golf ball of claim 1, wherein $T_{hmpl}$ has a non-uniform thickness T and comprises $P_c$ and $P_{c'}$ in a ratio $P_c:P_{c'}$ that varies throughout T.

7. The method of forming a golf ball of claim 1, wherein heated mixture $P_{cs}$ and heated mixture $P_{cs'}$ at least partially mix while being propelled onto the outermost surface.

* * * * *